US005784899A

United States Patent [19]

Nojima et al.

[11] Patent Number: 5,784,899

[45] Date of Patent: Jul. 28, 1998

[54] ARGON SEPARATION METHOD AND APPARATUS THEREFOR

[75] Inventors: Toshiyuki Nojima; Tomio Kura; Hideyuki Honda, all of Kawasaki, Japan

[73] Assignee: Nippon Sanso Corporation, Tokyo, Japan

[21] Appl. No.: 776,611

[22] PCT Filed: Jun. 19, 1996

[86] PCT No.: PCT/JP96/01683

§ 371 Date: Feb. 20, 1997

§ 102(e) Date: Feb. 20, 1997

[87] PCT Pub. No.: WO97/01068

PCT Pub. Date: Jan. 9, 1997

[30] Foreign Application Priority Data

Jun. 20, 1995 [JP] Japan ..... 7-153701

[51] Int. Cl.[6] ..... F25J 3/04

[52] U.S. Cl. ..... 62/648; 62/924

[58] Field of Search ..... 62/643, 648, 924, 62/903

[56] References Cited

U.S. PATENT DOCUMENTS

| | | | |
|---|---|---|---|
| 3,127,260 | 3/1964 | Smith | 62/924 X |
| 3,596,471 | 8/1971 | Streich | 62/924 X |
| 4,784,677 | 11/1988 | Al-Ahalabi . | |
| 4,983,194 | 1/1991 | Hopkins et al. | 62/924 X |
| 5,019,145 | 5/1991 | Rohde et al. . | |
| 5,159,816 | 11/1992 | Kovak et al. | 62/924 X |
| 5,207,066 | 5/1993 | Bova et al. | 62/924 X |
| 5,255,522 | 10/1993 | Agrawal et al. . | |

FOREIGN PATENT DOCUMENTS

| | | |
|---|---|---|
| 0 321 163 A2 | 6/1989 | European Pat. Off. . |
| 52-41235 | 10/1977 | Japan . |
| 61-42072 | 11/1986 | Japan . |
| 6-109361 | 4/1994 | Japan . |

*Primary Examiner*—Christopher Kilner

*Attorney, Agent, or Firm*—Oblon, Spivak, McClelland, Maier & Neustadt, P.C.

[57] ABSTRACT

The present invention employs a dry-type condenser capable of heat exchange even at small temperature difference for the condensers for the crude argon column, deoxidation column, and pure argon column in an argon separation apparatus using air liquefication and distillation. Additionally, oxygen-enriched liquefied air withdrawn from a plate which is higher than the bottom of the higher pressure column of a double distillation column is employed as the cold source for the condensers. As a result, a large temperature difference between the condensive and vaporative sides of each column's condensers can be obtained. Moreover, even when the total number of theoretical steps of the crude argon column and the deoxidation column exceeds 100, it is not necessary to provide a blower to increase pressure of the crude argon. Thus, the cost of the apparatus and its operation can be reduced. In addition, the condenser of each column can be made smaller and more compact, while the time required to start-up operation can be reduced. Further, by employing liquefied air withdrawn from a plate above the bottom of the column, the hazards from deposition of hydrocarbons are eliminated.

13 Claims, 6 Drawing Sheets

ARGON SEPARATION METHOD AND APPARATUS THEREFOR

TECHNICAL FIELD

The present invention relates to an argon separation method in which argon is separated and collected by means of an air liquefying separation method, and to a apparatus employing this argon separation method.

BACKGROUND ART

FIG. 4 shows an example of a conventional argon separation apparatus which employs an air liquefying separation method.

Material air pressurized to approximately 6 kg/cm$^2$ from which moisture and $CO_2$ have been removed is cooled to its dew point, and sent from pipe 1 into the lower portion of higher pressure column 3 of double distillation column 2. There, this material air is distilled and separated into liquefied air rich in oxygen, nitrogen gas and liquified nitrogen.

The liquefied nitrogen is withdrawn from the upper portion of higher pressure column 3, passed through pipe 4, supercooler 5, pipe 6, expansion valve 7, and pipe 8, and then introduced as reflux liquid to the upper portion of lower pressure column 9.

The nitrogen gas is effluxed from the upper portion of higher pressure column 3 via pipe 10. Oxygen-enriched liquefied air collects at the bottom of higher pressure column 3, and is withdrawn via pipe 11. The liquefied air withdrawn in this manner is then sent via supercooler 12, pipe 13, expansion valve 14 and pipe 15 to a crude argon condenser 17 located at the top of crude argon column 16. There, a portion of the liquefied air vaporizes, providing cold, after which the liquefied air is introduced to the middle portion of lower pressure column 9 via pipe 18.

The liquid fraction introduced from pipes 8 and 18 flows down through lower pressure column 9 as reflux liquid, and then rises up through lower pressure column 9 after being vaporized at a condensive evaporator 19. Distillation proceeds as a result of contact between the liquid which is coming down and the gas which is rising up through lower pressure column 9. As a result, nitrogen gas is effluxed through pipe 20 from the upper portion of lower pressure column 9, while waste gas is effluxed through pipe 21. Argon material gas which includes mainly oxygen but also argon in the amount of 5 to 15% and trace amounts of nitrogen (argon-containing oxygen gas) is withdrawn from the middle portion of column 9 via pipe 22, and introduced into the lower portion of crude argon column 16.

The argon material gas introduced into crude argon column 16 rises up through column 16, and is liquefied at crude argon condenser 17. A portion of this liquefied argon is removed via pipe 23 as liquefied crude argon, subjected to a deoxidizing process (not shown in the figure), and sent to a pure argon column to be distilled into highly pure argon.

The remaining liquefied crude argon flows down through column 16, comes in contact with the rising gas, collects at the bottom of the column as liquefied oxygen containing a low concentration of argon, and is sent back to lower pressure column 9 via pipe 24.

An immersion-type condenser 25 such as shown in FIG. 5 may be employed for crude argon condenser 17 of crude argon column 16. This immersion-type condenser 25 is designed such that a heat exchanger 27 is disposed inside a liquid collecting portion 26 for holding the liquefied air which is formed at the top of crude argon column 16. This heat exchanger 27 is almost completely immersed in the liquefied air. A straight pipe, plate-fin, or other design may be employed for heat exchanger 27.

However, an immersion-type condenser 25 as described above has the following drawbacks. To begin with, the liquefied air stored in liquid collecting portion 26 contains much component which have higher boiling points above that of the liquefied air inside pipe 15, and is at a temperature which is higher than that of the liquefied air inside pipe 15. Further, because the temperature of the liquefied air on the side at which vaporization is occurring is higher at the bottom portion of condenser 25 due to the liquid air head, the temperature difference between the condensive side and the vaporative side of the condenser is reduced. Moreover, heat exchanger 27 and liquid reservoir portion 26 are necessary from a design perspective, making it difficult to construct a compact apparatus. Furthermore, the above-described immersion-type condenser 25 is also disadvantageous in that some time is required at the start-up of the apparatus until liquid accumulates in liquid reservoir portion 26.

In order to resolve these problems, the application of the dry-type condenser disclosed in Japanese Utility Model Registration No. 1687518 was attempted.

As shown in FIG. 6, a heat exchanger 27 is disposed to the upper portion of crude argon column 16 in this dry-type condenser 28. Heat exchanger 27 is not immersed in the liquefied air, but rather, the liquefied air flows through cold medium passages in heat exchanger 27, undergoing heat exchange with an argon-containing gas which has been introduced into the argon passages. The liquid air is thus effluxed after being completely vaporized.

In this dry-type condenser 28, there is no increase in temperature of the cooled portion of the liquefied air at the vaporative side due to the liquid head of the immersion liquid, such as occurs in an immersion-type condenser. As a result, it is possible to provide a large temperature difference between the liquefied air and the argon-containing gas, while also facilitating a more compact apparatus. However, depending on the conditions, it is possible that hydrocarbons such as methane or ethylene accompanying the liquefied air become concentrated on the heat-transmitting surface of the condenser that is in contact with the liquefied air, and deposit out, giving rise to the possibility of an explosion.

Japanese Patent Application, First Publication, No. Hei 6-109361 proposes another method for separating argon, in which the removal of the oxygen in crude argon is not performed by reaction with hydrogen, but is carried out using a distillation column (deoxidation column).

As shown in FIG. 7, crude argon effluxed from crude argon column 16 is sent to crude argon heat exchanger 29, and heated to room temperature. After increasing pressure using a blower 30, the crude argon is cooled at crude argon heat exchanger 29. Next, the cooled crude argon is introduced into a deoxidation column 31 which has a theoretical plate number of 70 or more. Distilling is performed, and deoxidized argon containing 1 ppm or less of oxygen is effluxed from the upper part of deoxidation column 31. The deoxidized argon is then sent to pure argon column 32, to obtain highly pure argon.

This separation method is advantageous in that oxygen can be removed from crude argon without employing hydrogen gas, thus increasing the safety of the operation.

However, because there is only a small difference in the boiling points of oxygen and argon, it is not possible to sufficiently separate the oxygen and argon unless the number of theoretical steps is over 70, with the result that the loss of pressure inside crude argon column 16 and deoxidation column 31 becomes great. Thus, it is not possible to achieve a large temperature difference at condenser 33 at the upper portion of deoxidation column 31, leading to less efficient distillation. Accordingly, as shown in the figure, it becomes necessary to provide blower 30 for increasing pressure on the crude argon. This in turn requires the provision of crude argon heat exchanger 29. As a result, the cost of the apparatus and its operation increases substantially.

Accordingly, in a process for removing oxygen from crude argon using a deoxidation column in which a dry-type condenser can be employed for the condensers of the crude argon column and the pure argon column while maintaining a sufficient degree of safety, the present invention ensures that the combined number of steps in the crude argon column and the deoxidation column is sufficient by employing a dry-type condenser for the deoxidation column, while at the same time providing the temperature difference necessary for condensation and reducing the cost of the apparatus and its operation. Further, the present invention provides for obtaining the same effects by using a dry-type condenser for the condenser of an argon column wherein the crude argon column and the deoxidation column are formed in a unitary manner.

DISCLOSURE OF INVENTION

The present invention relates to a apparatus and method for separating argon by liquefying and distilling air, wherein a dry-type condenser capable of heat exchange even at small temperature difference is employed for the condensers for the crude argon column, pure argon column, deoxidation column and argon column. Oxygen-enriched liquefied air withdrawn from a plate(stage) which is higher than the bottom of the higher pressure column in a double distillation column and is at a temperature which is lower than the liquid at the bottom of the higher pressure column, is employed as the cold source for the condensers in this case.

The oxygen-enriched liquefied air is preferably withdrawn from a plate which is 3 to 5 stages above the bottom of the higher pressure column, this position providing more favorable results in terms of the amount and purity of the oxygen and nitrogen collected throughout the entire process, and the prevention of hazards from hydrocarbon deposition.

Further, by using packing in these distillation columns, the pressure loss inside the columns is reduced, making it possible to achieve greater temperature difference at the condenser.

The present invention may be embodied as follows.

(1) An argon separation method in which air is liquefied and distilled in a double distillation column, the oxygen and nitrogen is collected, argon-containing oxygen is withdrawn from the lower pressure column in the double distillation column, and guided into a crude argon column where it is distilled to obtain crude argon; which comprised a dry-type condenser is employed as the crude argon condenser of the crude argon column, and liquefied air withdrawn from a plate(stage) above the bottom of the higher pressure column is supplied as a cold source for the condenser.

(2) An argon separation method in which air is liquefied and distilled in a double distillation column, the oxygen and nitrogen is collected, argon-containing oxygen is withdrawn from the lower pressure column, directed into a crude argon column, distilled to obtain crude argon, and the crude argon is sent to a deoxidation column and distilling to obtain deoxidized argon; which comprised a dry-type condenser is employed as the condenser of the deoxidation column, and liquefied air withdrawn from a plate(stage) above the bottom of the higher pressure column is supplied as a cold source for the condenser.

(3) An argon separation method in which air is liquefied and distilled in a double distillation column, the oxygen and nitrogen is collected, argon-containing oxygen is withdrawn from the lower pressure column, directed into a crude argon column and distilled to obtain crude argon, and the crude argon is sent to a deoxidation column and distilled to obtain deoxidized argon; which comprised the crude argon column and the deoxidation column are formed into a integrated body, a dry-type condenser is employed as the condenser for the column, and liquefied air withdrawn from a plate(stage) above the bottom of the higher pressure column is supplied as the cold source for the dry-type condenser.

(4) An argon separation method in which air is liquefied and distilled in a double distillation column, the oxygen and nitrogen is collected, argon-containing oxygen is withdrawn from the lower pressure column, sent into one or two distillation columns, distilled to obtain deoxidized argon, and the deoxidized argon is sent to the pure argon column and distilled to obtain highly pure argon; which comprised a dry-type condenser is employed as the condenser for the pure argon column, and liquefied air withdrawn from a plate above the bottom of the higher pressure column is supplied as the cold source for the dry-type condenser.

(5) An argon separation method according to one of the above (1) through (4), which comprised the liquefied air is withdrawn from a plate(stage) which is 3 to 5 stages above the bottom of the higher pressure column.

(6) An argon separation method according to one of the above (2) through (4), which comprised one or more of the lower pressure column of the double distillation column, the crude argon column and the deoxidation column, is a packed column.

The structure of the apparatus in the embodiments of the present invention is as follows.

(7) An argon separation apparatus comprised with a double distillation column for liquefying and distilling air and collecting oxygen and nitrogen, and a crude argon column for withdrawing argon-containing oxygen from the lower pressure column of the double distillation column, distilling the withdrawn argon-containing oxygen and collecting crude argon; wherein the crude argon condenser for the crude argon column is a dry-type condenser, the liquefied air is withdrawn from a plate(stage) which is above the bottom of the higher pressure column of the double distillation column, and a duct line is provided for sending the liquefied air to cold medium passages of the dry-type condenser.

(8) An argon separation apparatus comprised with a double distillation column for liquefying and distilling air and collecting oxygen and nitrogen, a crude argon column for withdrawing argon-containing oxygen from the lower pressure column of the double distillation column and distilling the withdrawn argon-containing oxygen to obtain crude argon, and a deoxidation column into which the crude argon obtained from the crude argon column is introduced and distilled to remove oxygen to obtain deoxidized argon; wherein the condenser for the deoxidation column is a dry-type condenser, the liquefied air is withdrawn from a plate(stage) which is above the bottom of the higher pressure column of the double distillation column, and a duct line is provided for sending the liquefied air to cold medium passages of the dry-type condenser.

(9) An argon separation apparatus comprised with a double distillation column for liquefying and distilling air and collecting oxygen and nitrogen, and an argon column for withdrawing argon-containing oxygen from the lower pressure column of the double distillation column, distilling the withdrawn argon-containing oxygen and removing the oxygen to obtain deoxidized argon; wherein the condenser for the argon column is a dry-type condenser, the liquefied air is withdrawn from a plate (stage) which is above the bottom of the double distillation column, and a duct line is provided for sending the liquefied air to cold medium passages of the dry-type condenser.

(10) An argon separation apparatus comprised with a double distillation column for liquefying and distilling air and collecting oxygen and nitrogen, a crude argon column for withdrawing argon-containing oxygen from the lower pressure column of the double distillation column, distilling the withdrawn argon-containing oxygen and collecting crude argon, and a deoxidation column into which crude argon obtained in the crude argon column is introduced, and distilled to remove oxygen to obtain deoxidized argon, and a pure argon column into which deoxidized argon obtained in the deoxidation column is introduced, and distilled to obtain highly pure argon; wherein the condenser for the pure argon column is a dry-type condenser, the liquefied air is withdrawn from a plate(stage) which is above the bottom of the higher pressure column of the double distillation column, and a duct line is provided for sending the liquefied air to cold medium passages of the dry-type condenser.

(11) An argon separation apparatus comprised with a double distillation column for liquefying and distilling air and collecting oxygen and nitrogen, an argon column for withdrawing argon-containing oxygen from the lower pressure column of the double distillation column, distilling the withdrawn argon-containing oxygen to obtain deoxidized argon, and a pure argon column into which the deoxidized argon obtained in the argon column is introduced and distilled to obtain highly pure argon; wherein, the condenser for the pure argon column is a dry-type condenser, the liquefied air is withdrawn from a plate (stage) which is above the bottom of the higher pressure column of the double distillation column, and a duct line is provided for sending the liquefied air to cold medium passages of the dry-type condenser.

(12) An argon separation apparatus according to one of the above (7) through (10), which comprised the position of withdrawal of the liquefied air from the pipes is a plate (stage) which is 3 to 5 stages above the bottom of the higher pressure column of the double distillation column.

(13) An argon separation apparatus according to one of the above (8) through (10), which comprised one or more of the lower pressure column of the double distillation column, the crude argon column, the deoxidation column, the argon column and the pure argon column is a packed column.

(14) An argon separation apparatus according to one of the above (7) through (13), which comprised one or more of the lower pressure column of the double distillation column, the crude argon column, the deoxidation column, the argon column and the pure argon column is formed by partially packing with a packing material.

BEST MODE FOR CARRYING OUT THE INVENTION

The present invention will now be explained in greater detail.

Figure 1:
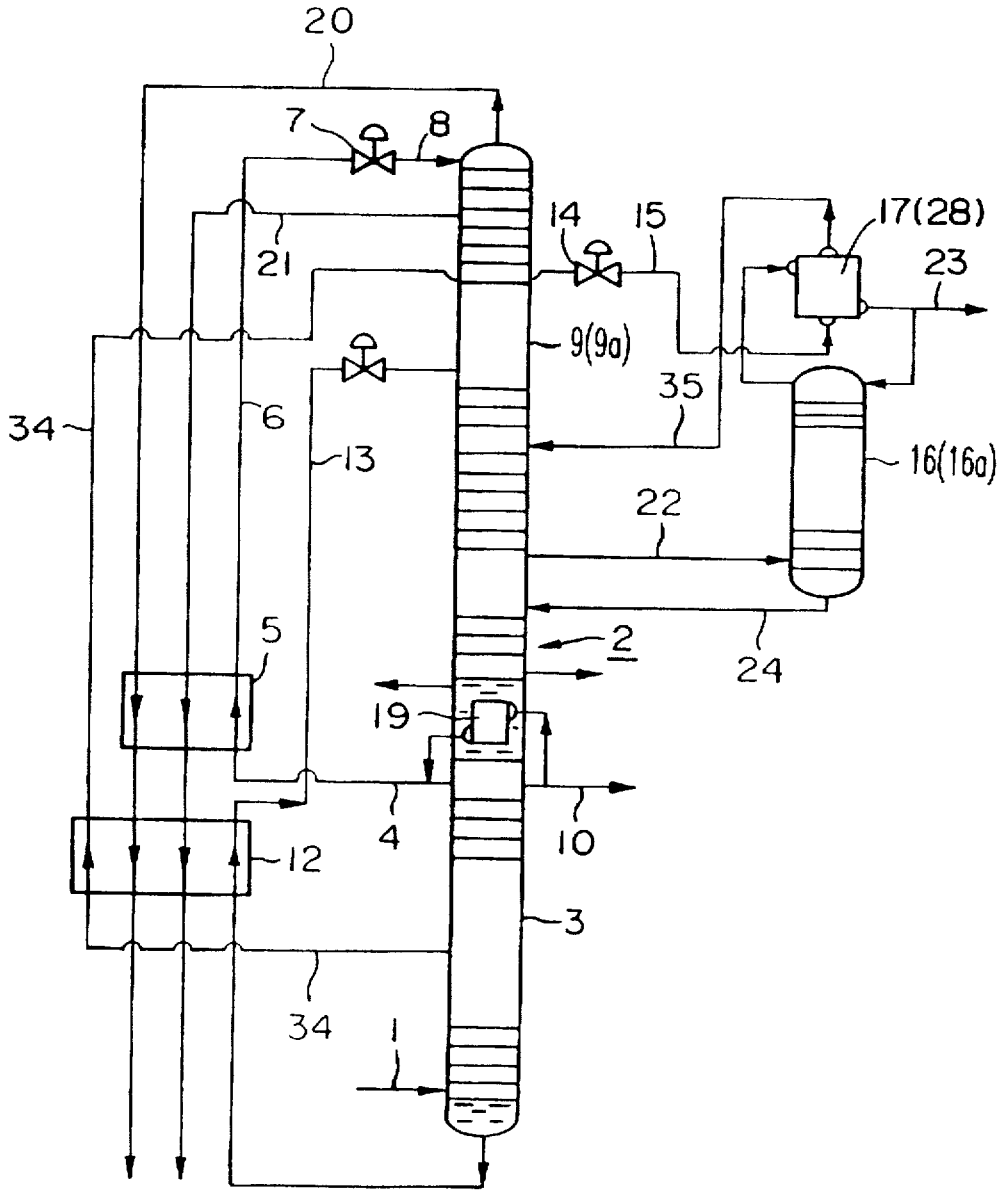
FIG. 1 is a schematic flow diagram of an argon separation apparatus showing a first example of the present invention.
Figure 4:
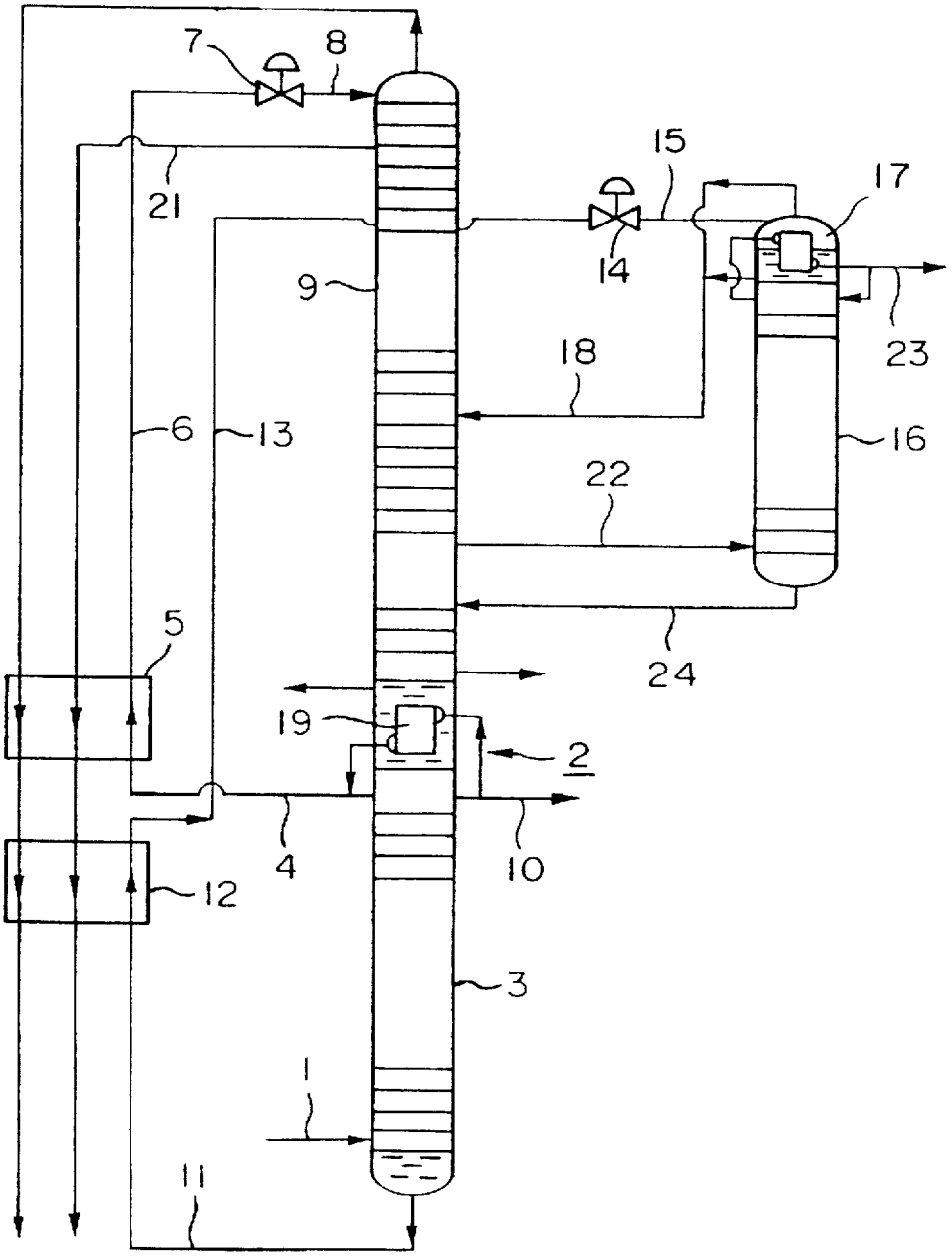
FIG.4 PRIOR ART
FIG. 4 is a schematic flow diagram of a conventional argon separation apparatus.
Figure 5:
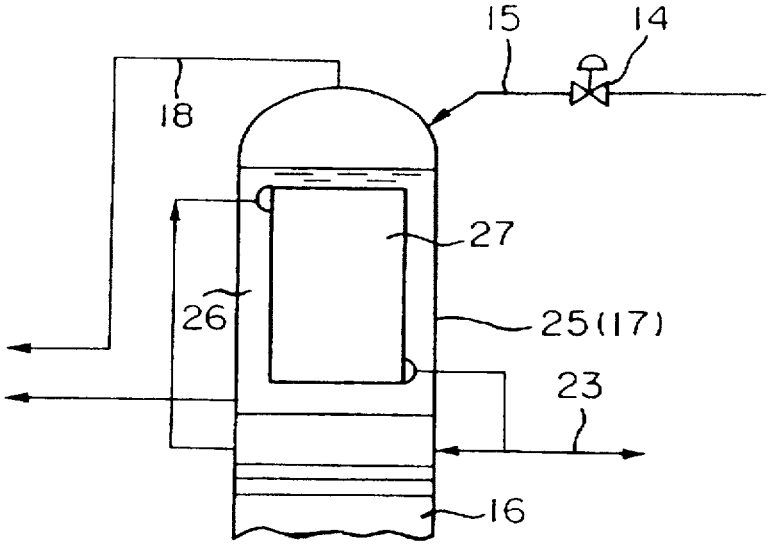
FIG.5 PRIOR ART
FIG. 5 is an abbreviated structural diagram showing an example of an immersion-type condenser.

FIG. 1 shows a first example of the present invention, corresponding to claims 1 and 6. Parts which are equivalent to those of the conventional apparatus shown in FIG. 4 have been assigned the same numeric symbol and an explanation thereof will be omitted.

Figure 6:
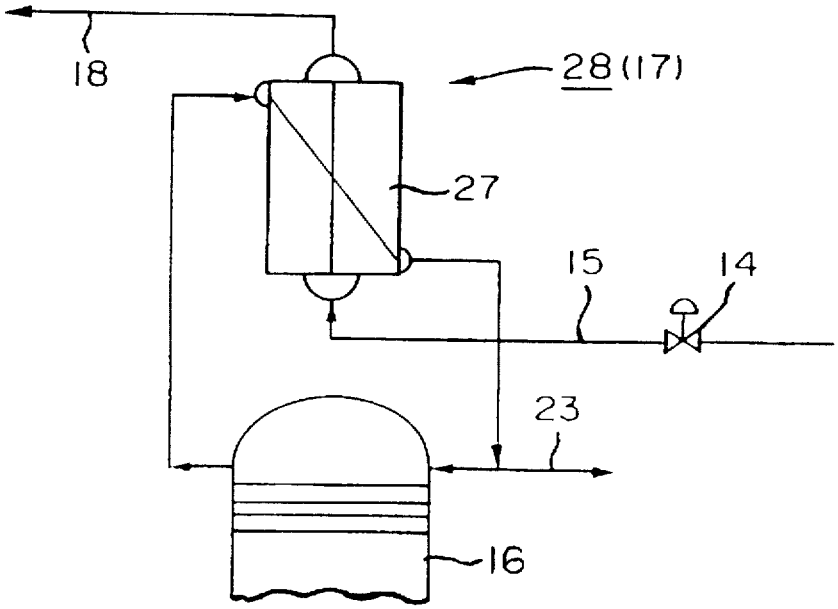
FIG. 6 is an abbreviated structural diagram showing an example of a dry-type condenser.
Figure 7:
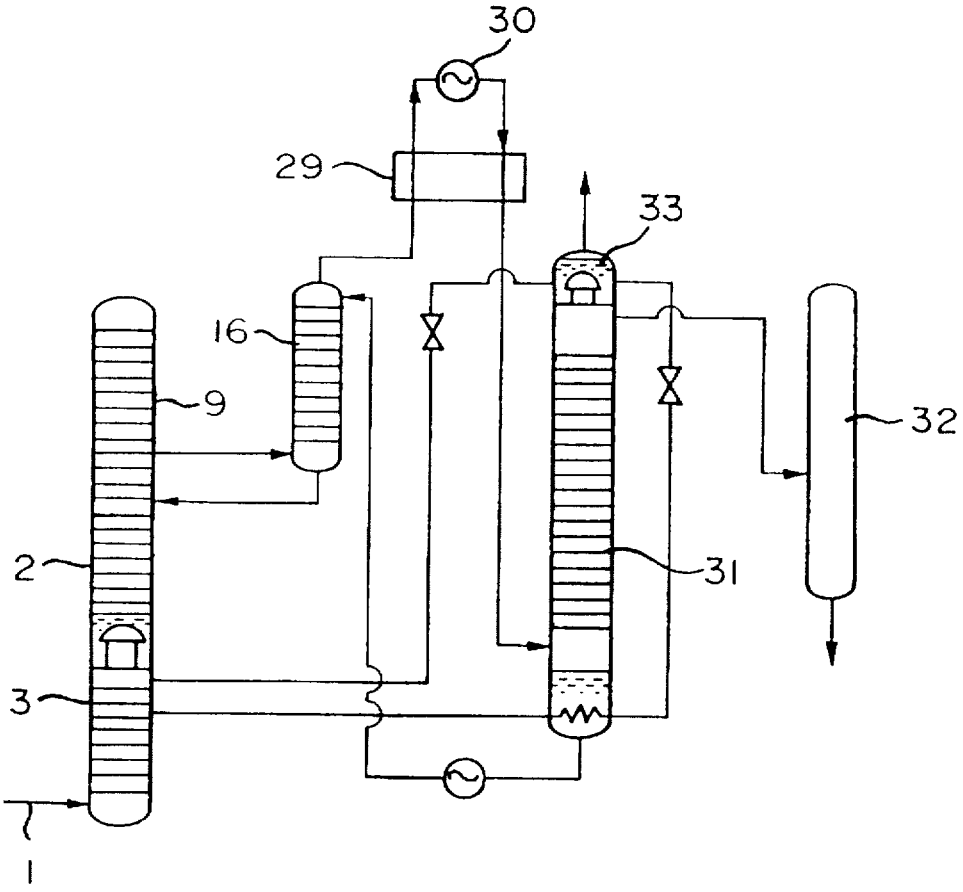
FIG.7 PRIOR ART
FIG. 7 is a schematic flow diagram showing another example of a conventional argon separation apparatus.

In this example, a dry-type condenser 28 such as shown in FIG. 6 has been employed for crude argon condenser 17 of crude argon column 16. Dry-type condenser 28 is separate from crude argon column 16. Liquefied air withdrawn from a rectification plate which is higher than the bottom of higher pressure column 3 of double distillation column 2 is sent in a mixed gas-liquid phase to cold medium passages (vaporization side) of the dry-type condenser 28 via pipe 34, supercooler 12, pipe 34, expansion valve 14 and pipe 15. The entire quantity of the liquefied air is vaporized at this point with giving cold, after which it is introduced to lower pressure column 9 via pipe 35.

The position of withdrawal of the liquefied air is designated to be a rectification plate which is located between the top stage of higher pressure column 3 and a stage which is several stages above the bottom of higher pressure column 3. However, in the case where the liquefied air is withdrawn from the higher rectification plates in this range, the reflux to lower pressure column 9 may be insufficient, effecting distillation in lower pressure column 9. Furthermore, reflux to plates below the withdrawal plate becomes less sufficient as withdrawal is carried out at higher rectification plates, so that distillation in higher pressure column 3 is not sufficient. As a result, the purity of the nitrogen gas produced deteriorates.

Therefore, in order to maintain a temperature difference and reduce the precipitation of hydrocarbons at condenser 17, it is preferable to withdraw the liquefied oxygen from a plate which is between a few to 10 plus several stages, and most preferably between 3 to 5 stages, above the lowest stage (bottom) of higher pressure column 3.

The temperature difference at condenser 17 of crude argon column 16 is determined according to the pressure inside the crude argon column and the dew point of the oxygen enriched liquefied air which is the cold source. The dew point is determined by the pressure and composition of the liquefied air.

Table 1 shows the relationship between the dew point at the operating pressure of the condenser for the crude argon column and the proportion (molar ratio) of nitrogen in the liquefied air at the each withdrawal stage for the cases where the position of withdrawal of the liquefied air from higher pressure column 3 ranges from the lowest stage through a stage which is 10 stages above the lowest stage. In addition, Table 1 also shows the concentration of hydrocarbons in the withdrawn liquid as a ratio of the hydrocarbon concentration in liquid withdrawn from the lowest stage (bottom of the column).

The data in Table 1 was collected in the case where liquid from the bottom of a regular higher pressure column having 59 stages was introduced as the cold liquid for the condenser of the crude argon column. Here, the number of stages was held constant at 59, liquefied air withdrawn from plates ranging from 1 to 10 stages above the bottom of the column supplied to the crude argon condenser.

TABLE 1

| Liquefied air withdrawal stage | Concentration N2 in liquefied air (ratio) | Dew point of liquefied air (K) | Methane concentration (ratio) (where lowest stage = 1) | Ethylene concentration (ratio) (where lowest stage = 1) | Total number of stages |
|---|---|---|---|---|---|
| column bottom | 0.5949 | 87.88 | 1.000 | 1.000 | 59 |
| 1 | 0.6002 | 87.11 | 0.230 | 0.004 | 59 |
| 2 | 0.6014 | 87.09 | 0.113 | $4 \times 10^{-5}$ | 59 |
| 3 | 0.6016 | 87.08 | 0.068 | trace | 59 |
| 4 | 0.6017 | 87.08 | 0.044 | trace | 59 |
| 5 | 0.6017 | 87.08 | 0.030 | trace | 59 |
| 6 | 0.6017 | 87.08 | 0.021 | trace | 59 |
| 7 | 0.6017 | 87.08 | 0.015 | trace | 59 |
| 8 | 0.6017 | 87.08 | 0.011 | trace | 59 |
| 9 | 0.6017 | 87.08 | 0.008 | trace | 59 |
| 10 | 0.6017 | 87.08 | 0.008 | trace | 59 |

As is clear from Table 1, the dew point drops by about 0.8K between the fourth stage and the lowest stage, making it possible to achieve a large temperature difference at crude argon condenser 17. For this reason, the argon rising up through crude argon column 16 condenses readily, leading to an increase in the reflux volume and more efficient distillation. Additionally, condenser 17 can be made more compact.

Further, hydrocarbons and $CO_2$ on the order of several ppm accompany the material air sent into higher pressure column 3 via pipe 1. The boiling point of this accompanying matter is higher than that of oxygen, so that the majority of this matter becomes concentrated in the liquefied air which collects at the bottom of higher pressure column 3.

It may also be understood from Table 1 that the concentration of hydrocarbons falls sharply as withdrawal of the liquefied air is carried out further above the bottom of the column.

For example, when withdrawing from a rectification plate which is five stages above the lowest stage, the methane concentration falls to just 0.030, as compared to when withdrawal is carried out at the lowest stage. Further, the ethylene concentration falls to less than $10^{-5}$ at this withdrawal position.

As a result, the amount of hydrocarbon precipitation is reduced markedly in the present invention, even when a dry-type condenser 28 is employed for crude argon condenser 17. Accordingly, a significant reduction in the hazards associated with hydrocarbon deposition is achieved.

Table 2 corresponds to the case where liquid at the bottom of an ordinary higher pressure column having 59 stages is effluxed and employed as a cryogenic liquid. Namely, liquefied air for use as a cold liquid for the condenser was withdrawn from each of the first through sixth stages above the bottom of the column, and supplied to the condenser of the crude argon column. A comparison was then made between the case where the number of stages above the withdrawal stage was always maintained at 59 and the case where the total number of stages was held at 59 and withdrawal was carried out at the sixth stage from the bottom of the column, with the results of these calculations shown in Table 2.

As is clear from Table 2, the amount of oxygen in the nitrogen at the top portion of the higher pressure column becomes almost constant when the liquefied air is withdrawn from sequentially higher stages above the bottom of the column and the number of distilling stages above the withdrawal stage is held constant at 59. On the other hand, if the total number of stages is held fixed (at 59 stages) and withdrawal is carried out at the sixth stage above the bottom of the column, then the oxygen concentration increases by about 6-fold.

The trends in the nitrogen concentration (boiling point of withdrawn liquid) and the hydrocarbon concentration in the withdrawn liquid are the same as in Table 1.

Accordingly, in order to maintain the temperature difference in the condenser of the crude argon column and to avoid hazards associated with hydrocarbons while maintaining the purity of the product nitrogen gas, it is desirable that a stage for withdrawing cold liquefied air be provided at a position higher than the bottom of the column, as well as that the total number of rectification plates(stages) be increased so that the predetermined number of plates of the higher pressure column which are situated higher than the withdrawal stage will be maintained.

TABLE 2

| Liqueified air withdrawal stage | Nitrogen concentration in liquefied air (ratio) | Dew point of liquefied air (K) | Methane concentration (ratio) (where lowest stage = 1) | Ethylene concentration (ratio) (where lowest stage = 1) | Total number of stages | Concentration oxygen in nitrogen at the top portion of the higher pressure column |
|---|---|---|---|---|---|---|
| column bottom | 0.5459 | 87.88 | 1.000 | 1.00000 | 59 | $1.67 \times 10^{-8}$ |
| 1 | 0.6002 | 87.11 | 0.230 | 0.00120 | 60 | $1.53 \times 10^{-8}$ |
| 2 | 0.6014 | 87.09 | 0.113 | 0.00004 | 61 | $1.50 \times 10^{-8}$ |
| 3 | 0.6016 | 87.08 | 0.063 | trace | 62 | $1.50 \times 10^{-8}$ |
| 4 | 0.6017 | 87.08 | 0.044 | trace | 63 | $1.49 \times 10^{-8}$ |
| 5 | 0.6017 | 87.08 | 0.030 | trace | 64 | $1.49 \times 10^{-8}$ |
| 6 | 0.6017 | 87.08 | 0.021 | trace | 65 | $1.49 \times 10^{-8}$ |
| 6 | 0.6017 | 87.08 | 0.021 | trace | 59 | $9.7 \times 10^{-8}$ |

As shown above, by raising the site of withdrawal of the liquefied air to a position above the lowest stage (column bottom), it becomes possible to achieve greater temperature difference at crude argon condenser 17, and to sharply reduce the amount of hydrocarbons depositing out.

However, since the amount of liquefied air supplied as a cold source to crude argon condenser 17 is around 30 to 40% of the volume of the material air introduced into higher pressure column 3, the amount of reflux liquid at stages below the withdrawal plate falls and the amount of change in the composition of the nitrogen decreases. As a result, the efficiency of distillation deteriorates, effecting the purity of the product nitrogen.

Accordingly, the position of withdrawal of the liquefied air is optimally set to be 3 to 5 stages above the column bottom.

Figure 2:
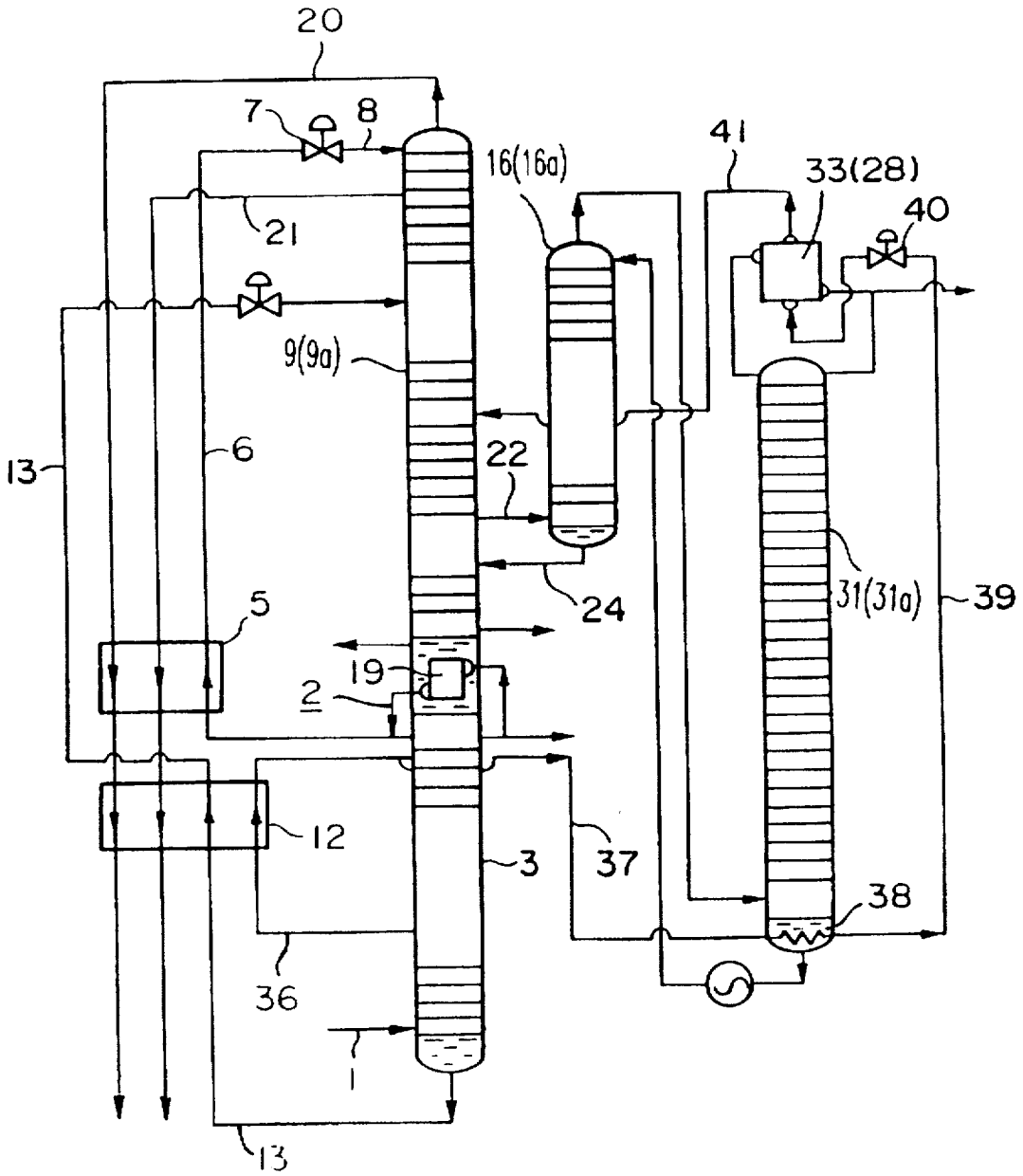
FIG. 2 is a schematic flow diagram of an argon separation apparatus showing a second example of the present invention.

FIG. 2 shows a second example of the present invention, corresponding to claims 2 and 7. In this figure, those parts which are equivalent to the parts of the conventional apparatus shown in FIG. 4 have been assigned the same numeric symbol and will not be explained.

In this example, the removal of oxygen in the crude argon is carried out by distillation at deoxidation column 31, a dry-type condenser 28 is employed for condenser 33 of deoxidation column 31, and liquefied air withdrawn from a plate(stage) above the bottom of higher pressure column 3 is employed as the cold source.

The liquefied air withdrawn from a plate which is higher than the bottom of column 3 is sent from pipe 36, through supercooler 12 and pipe 37 to reboiler 38 at the bottom of deoxidation column 31, where the crude argon is heated. The liquefied air then passes through pipe 39 and expansion valve 40, and is sent to dry-type condenser 28 which is provided to the top portion of deoxidation column 31. Here, the liquefied air provides a cold, is vaporized and then introduced into lower pressure column 9 via pipe 41.

By achieving a large temperature difference at condenser 28 in this example, a decline to some extent in the pressure of the argon gas at the top of deoxidation column 31, is permitted. Even if the combined total number of theoretical steps between crude argon column 16 and deoxidation column 31 exceeds 100, it is not necessary to provide a blower for increasing pressure on the crude argon, nor a crude argon heat exchanger which would necessarily accompany the blower.

However, even in this case, if the combined total number of theoretical stages (plates) between crude argon column 16 and deoxidation column 31 becomes too large, the pressure loss becomes great and it is no longer possible to ensure the necessary temperature difference at condenser 28. For this reason, the total number of theoretical stages is limited to 100 plus several 10 stages or less.

Ordinarily, the temperature difference between the condensive and vaporative sides of a condenser evaporator is about 2° C. However, when the combined total number of theoretical stages between crude argon column 16 and deoxidation column 31 increases, it becomes difficult to ensure this temperature difference at the condenser. As a result, it is necessary to limit the total number of stages or, alternatively, to provide a blower for increasing pressure on the crude argon. However, as shown in Table 1, when liquefied air is withdrawn from the fourth stage up from the lowest stage in higher pressure column 3, the boiling point falls by about 0.8 K. The combined total number of theoretical stages(plates) can be increased with the fall of the boiling point.

In the present invention, it is acceptable to provide an argon column in which the crude argon column and the deoxidation column are formed into a integrated body, a dry-type condenser is provided above the argon column, and liquefied air withdrawn from a plate(stage) which is higher than the bottom of the higher pressure column is provided as the cold source for the condenser.

In this case, the argon material gas which is withdrawn from the middle of the lower pressure column is introduced into the bottom of the argon column via a guide pipe, and distilled. The liquefied air which is withdrawn from a plate(stage) which is higher than the bottom of the higher pressure column is sent to the dry-type condenser which provide above the argon column via the guide pipe. The liquefied air supplies cold, is vaporized, and then guided into the lower pressure column via a guide pipe.

A portion of the deoxidized argon liquefied at the dry-type condenser flows down into the argon column, coming in contact with the argon material gas which has been introduced into the argon column. The argon material gas is distilled, and argon-containing liquefied oxygen collects in the bottom of the column. This argon-containing liquefied oxygen is then sent to the lower pressure column by means of a pump.

The remaining deoxidized argon liquefied at the dry-type condenser is withdrawn, sent to the pure argon column, and distilled to obtain highly pure argon.

In this example, as well, even if the total number of theoretical stages (plates) in the argon column exceeds 100, a large temperature difference can be obtained at the condenser.

As an applied example, it is also possible to form the crude argon column, deoxidation column, and pure argon column into a integrated body, employ a dry-type condenser as the condenser for the distillation column, and use liquefied air withdrawn from a plate(stage) higher than the bottom of the higher pressure column as a cold source for the condenser, to obtain highly pure argon.

Figure 3:
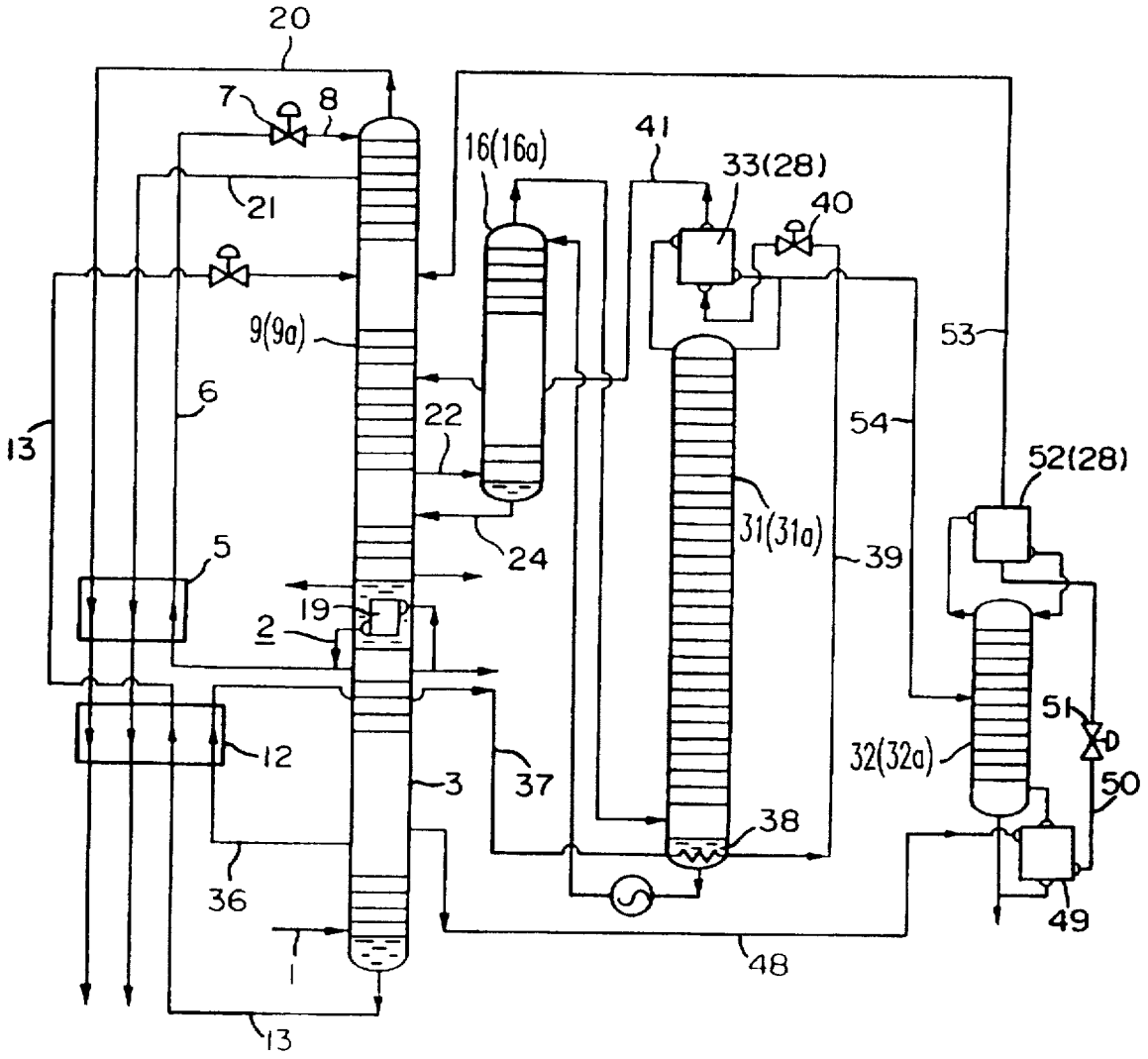
FIG. 3 is a schematic flow diagram of an argon separation apparatus showing a third example of the present invention.

FIG. 3 shows a third example of the present invention, corresponding to claims 3 and 8. In this example, a pure argon column 32 has been provided to the apparatus of example 2 shown in FIG. 2. Deoxidized argon from deoxidation column 31 is sent to pure argon column 32 via pipe 54, with a dry-type condenser 28 employed for condenser 52 of the pure argon column 32. Further, liquefied air withdrawn from a plate(stage) which is higher than the bottom of the higher pressure column 3 is employed as the cold source in this example.

Liquefied air withdrawn from a plate which is higher than the bottom of higher pressure column 3 is sent to reboiler 49 at the bottom of pure argon column 32 via pipe 48. After cooling here, the liquefied air is sent to dry-type condenser 52 via pipe 50 and expansion valve 51. The entire volume of liquefied air is vaporized at the condenser, providing cold, after which it passes through pipe 53 and is returned to lower pressure column 9.

Further, it is also acceptable in the present invention to constitute the lower pressure column, the crude argon column, the deoxidation column, or the pure argon column by a packed column, 9*a*, 16*a*, 31*a*, 32*a* filled with regular or irregular packing material, to employ a dry-type condenser for the condenser of the deoxidation column, and to use liquefied air withdrawn from a plate which is higher than the bottom of the higher pressure column as the cold source.

By employing this type of packed column, the pressure loss at each column is reduced, while a larger temperature difference at the condenser can be obtained as compared to a sieve tray column. Further, the total number of theoretical stages(plates) between the crude argon column and the deoxidation column can be set up to about 200. In this case, the nitrogen concentration in the deoxidized argon effluxed from the top of the deoxidation column is less than 0.1 ppm.

As an applied example, the lower pressure column, crude argon column and deoxidation column can be formed in an optional combination of packed columns and sieve tray columns. Further, a packed column may be employed for one or both of the argon column and pure argon column. Additionally, one of the aforementioned columns may be filled with a packing material, while the others are formed of sieve trays.

INDUSTRIAL FIELD OF APPLICATION

The present invention's argon separation method and apparatus employ a dry-type condenser capable of heat exchange even at small temperature difference for the condensers of the crude argon column, deoxidation column, argon column and pure argon column. Additionally, oxygen enriched liquefied air withdrawn from a plate(stage) that is higher than the bottom of the higher pressure column in a double distillation column, which is at a temperature below that of the liquid at the bottom of the column, may be employed as the cold source for the condensers.

As a result, it is possible to obtain a large temperature difference between the condensive and vaporative sides of the condensers of each of the columns, while also providing for a smaller, more compact apparatus. Additionally, the hazard from deposition of hydrocarbons is also eliminated.

Even in the case where the total number of theoretical stages between the crude argon column and the deoxidation column exceeds 100, it is not necessary to provide a blower to increase pressure on the crude argon. Accordingly, the cost of the apparatus and its operation can be reduced.

Further, by employing a packed column for each of the columns, the pressure loss inside the columns is reduced, while a large temperature difference can be obtained at the condensers.

We claim:

1. An argon separation method in which air is liquefied and distilled in a double distillation column, oxygen and nitrogen are collected, argon-containing oxygen is withdrawn from the lower pressure column of the double distillation column, directed into a crude argon column, and distilled to obtain crude argon; comprised, a dry-type condenser is employed as the crude argon condenser for the crude argon column, and liquefied air withdrawn from a plate which is higher than the bottom of the higher pressure column is supplied as a cold source for the condenser.

2. An argon separation method in which air is liquefied and distilled in a double distillation column, oxygen and nitrogen is collected, argon-containing oxygen is withdrawn from the lower pressure column of the double distillation column, directed into a crude argon column, distilled to obtain crude argon, and the obtained crude argon is sent to a deoxidation column, and distilled to obtain deoxidized argon; comprised, a dry-type condenser is employed as the condenser for the deoxidation column, and liquefied air withdrawn from a plate which is higher than the bottom of the higher pressure column is supplied as a cold source for the condenser.

3. An argon separation method in which air is liquefied and distilled in a double distillation column, oxygen and nitrogen are collected, argon-containing oxygen is withdrawn from the lower pressure column, sent to one or two distillation columns, distilled to obtain deoxidized argon, and the deoxidized argon is sent to a pure argon column and distilled to obtain pure argon; comprised, a dry-type condenser is employed as the condenser for the pure argon column, and liquefied air withdrawn from a plate which is higher than the bottom of the higher pressure column is supplied as a cold source for the dry-type condenser.

4. An argon separation method according to at least one of claims 1 through 3, in which the liquefied air is withdrawn from a plate which is from 3 to 5 stages above the bottom of the higher pressure column.

5. An argon separation method according to at least one of claims 1 through 3, wherein one or more of the lower pressure column, the crude argon column, and the deoxidation column is a packed column.

6. An argon separation apparatus comprised with a double distillation column for liquefying and distilling air and collecting oxygen and nitrogen, and a crude argon column for withdrawing argon-containing oxygen from the lower pressure column of the double distillation column, distilling the withdrawn argon-containing oxygen and collecting crude argon; wherein, the crude argon condenser for the crude argon column is a dry-type condenser, the liquefied air is withdrawn from a plate which is higher than the bottom of the higher pressure column of the double distillation column, and a duct line is provided for sending the liquefied air to flow passage of the dry-type condenser for cold medium.

7. An argon separation apparatus comprised with a double distillation column for liquefying and distilling air and collecting oxygen and nitrogen, a crude argon column for withdrawing argon-containing oxygen from the lower pressure column of the double distillation column, and distilling the withdrawn argon-containing oxygen to obtain crude argon, and a deoxidation column into which the crude argon obtained from the crude argon column is introduced, and distilled to remove oxygen to obtain deoxidized argon; wherein, the condenser for the deoxidation column is a dry-type condenser, the liquefied air is withdrawn from a plate which is higher than the bottom of the higher pressure column of the double distillation column, and a duct line is provided for sending the liquefied air to flow passage of the dry-type condenser for cold medium.

8. An argon separation apparatus comprised a double distillation column for liquefying and distilling air and collecting oxygen and nitrogen, an crude argon column for withdrawing argon-containing oxygen from the lower pressure column of the double distillation column and distilling the withdrawn argon-containing oxygen to obtain crude argon, a deoxidation column into which the crude argon obtained at the crude argon column is introduced and distilled to remove the oxygen to obtain deoxidized argon, and a pure argon column into which the deoxidized argon obtained at deoxidation column is introduced and distilled to obtain highly pure argon; wherein, the condenser for the pure argon column is a dry-type condenser, the liquefied air is withdrawn from a plate which is higher than the bottom of the higher pressure column of the double distillation column, and a duct line is provided for sending the liquefied air to flow passage of the dry-type condenser for cold medium.

9. An argon separation apparatus according to claim 7, wherein a reboiler is provided at a bottom of said deoxidation column, and said duct line passes through said reboiler.

10. An argon separation apparatus according to claim 8, wherein a reboiler is provided at a bottom of said pure argon column, and said duct line passes through said reboiler.

11. An argon separation apparatus comprising a double distillation column for liquefying and distilling air and collecting oxygen and nitrogen, and an argon column for withdrawing argon-containing oxygen from the lower pressure column of the double distillation column, distilling the withdrawn argon-containing oxygen and collecting deoxidized argon; wherein, the argon condenser for the argon column is a dry-type condenser, which his provided above the argon column, the liquefied air is withdrawn from a plate which is higher than the bottom of the higher pressure column of the double distillation column, and a duct line is provided for sending the liquefied air to a flow passage of the dry-type condenser for cold medium.

12. An argon separation apparatus according to at least one of claims 6 through 8 and claim 11, wherein the position of withdrawal of the liquefied air for the duct line is a plate which is from 3 to 5 stages higher than the bottom of the higher pressure column.

13. An argon separation apparatus according to at least one of claims 6 through 8 and claim 11, wherein one or more of the lower pressure column of the double distillation column, the crude argon column, the argon column, the deoxidation column and the pure argon column is a packed column.

* * * * *